US012623111B2

(12) United States Patent
DeGroot

(10) Patent No.: US 12,623,111 B2
(45) Date of Patent: May 12, 2026

(54) RETRACTABLE HANDHELD EXERCISE APPARATUS

(71) Applicant: Michael Allen DeGroot, Indian Head Park, IL (US)

(72) Inventor: Michael Allen DeGroot, Indian Head Park, IL (US)

(73) Assignee: Michael DeGroot, Indian Head Park, IL (US)

( * ) Notice: Subject to any disclaimer, the term of this patent is extended or adjusted under 35 U.S.C. 154(b) by 0 days.

(21) Appl. No.: 17/709,772

(22) Filed: Mar. 31, 2022

(65) Prior Publication Data

US 2023/0310921 A1 Oct. 5, 2023

(51) Int. Cl.

| | |
|---|---|
| ***A63B 21/00*** | (2006.01) |
| ***A63B 21/04*** | (2006.01) |
| ***A63B 23/035*** | (2006.01) |
| ***A63B 23/12*** | (2006.01) |

(52) U.S. Cl.

CPC ..... *A63B 21/153* (2013.01); *A63B 21/0442* (2013.01); *A63B 21/4023* (2015.10); *A63B 21/4035* (2015.10); *A63B 21/4043* (2015.10); *A63B 23/03541* (2013.01); *A63B 23/12* (2013.01)

(58) Field of Classification Search

CPC ..... A63B 21/00058; A63B 21/00069; A63B 21/00076; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/15; A63B 21/151; A63B 21/153; A63B 21/154; A63B 21/157; A63B 21/4023; A63B 21/4035; A63B 21/4039; A63B 21/4043; A63B 23/03541; A63B 23/12

See application file for complete search history.

(56) References Cited

U.S. PATENT DOCUMENTS

| | | | | | |
|---|---|---|---|---|---|
| 4,501,230 | A * | 2/1985 | Talo | A01K 27/004 | 119/796 |
| 5,876,310 | A * | 3/1999 | Mackey | A63B 21/4025 | 482/114 |
| 5,887,550 | A * | 3/1999 | Levine | A01K 27/004 | 119/796 |
| 5,938,137 | A * | 8/1999 | Poulson | B65H 75/48 | 242/379.2 |
| 6,024,054 | A * | 2/2000 | Matt | A01K 27/006 | 119/796 |

(Continued)

FOREIGN PATENT DOCUMENTS

| | | | | |
|---|---|---|---|---|
| DE | 10261211 | A1 * | 7/2004 | A63B 21/0004 |
| DE | 102011015204 | A1 * | 9/2012 | A63B 21/00069 |
| EP | 2505233 | A1 * | 10/2012 | A63B 21/00043 |

*Primary Examiner* — Gary D Urbiel Goldner

(57) ABSTRACT

Methods and systems for a retractable handheld exercise apparatus. The methods and systems generate a movement similar to upper body ski poling whereby a pair of handheld units [A] are connected to a fixed object by an attachment means [B] and are moved in an upper body walking motion to and from the fixed attachment point along a cable [C]. The apparatus includes functionality to increase or decrease tension which changes the amount of force required to pull the unit away from the fixed point.

6 Claims, 10 Drawing Sheets

(56) References Cited

U.S. PATENT DOCUMENTS 6,149,559 A * 11/2000 Mackey ..... A63B 21/16 482/904
6,405,683 B1 * 6/2002 Walter ..... A01K 27/004 119/772
6,694,922 B2 * 2/2004 Walter ..... A01K 27/004 119/772
7,040,257 B2 * 5/2006 Waxman ..... A01K 27/004 242/405
7,087,001 B1 * 8/2006 Ihli ..... A63B 21/015 D30/153
7,621,856 B1 * 11/2009 Keith ..... A63B 23/1218 119/796
7,762,215 B2 * 7/2010 Horton ..... A45F 5/004 242/379.2
8,075,453 B1 * 12/2011 Wilkinson ..... A63B 21/4019 482/8
8,105,214 B2 * 1/2012 Jahns ..... A63B 23/0355 482/110
8,201,964 B2 * 6/2012 Mattheis ..... A01K 27/004 119/796
8,556,783 B1 * 10/2013 Ihli ..... A63B 21/4035 482/44
8,935,993 B2 * 1/2015 Fox ..... A01K 27/008 119/796
9,155,287 B2 * 10/2015 Messner ..... B65H 75/4431
9,814,217 B2 * 11/2017 Zhu ..... A01K 27/004
9,943,071 B2 * 4/2018 Hill ..... B65H 75/4426
10,039,266 B2 * 8/2018 Bova ..... A01K 27/005
10,172,327 B2 * 1/2019 Holmstrom ..... B25G 1/102
10,420,327 B2 * 9/2019 Zhu ..... A01K 27/004
10,478,662 B2 * 11/2019 Davis ..... A63B 21/4013
10,893,660 B2 * 1/2021 Hill ..... B65H 75/4428
11,033,003 B1 * 6/2021 Burkhardt ..... B65H 75/486
2004/0043873 A1 * 3/2004 Wilkinson ..... A63B 21/00065 482/52
2004/0237907 A1 * 12/2004 Muller ..... B65H 75/4431 119/796
2005/0124471 A1 * 6/2005 Wilkinson ..... A63B 21/4021 482/121
2005/0227833 A1 * 10/2005 Wilkinson ..... A63B 21/0004 482/139
2006/0052189 A1 * 3/2006 Morrison ..... A63B 67/10 473/576
2006/0162675 A1 * 7/2006 Ghalebi ..... A01K 27/006 119/796
2007/0022972 A1 * 2/2007 Morrison ..... A01K 15/025 119/707
2007/0131177 A1 * 6/2007 Perkitny ..... A01K 27/004 119/796
2007/0204806 A1 * 9/2007 Hurwitz ..... A44C 15/0015 119/796
2012/0322635 A1 * 12/2012 Carter ..... A63B 21/0442 482/129
2017/0056702 A1 * 3/2017 Carter ..... A63B 21/0442
2019/0001175 A1 * 1/2019 Wagner ..... A63B 21/22
2021/0353994 A1 * 11/2021 Paz Domonte ..... A63B 21/153
2022/0080247 A1 * 3/2022 Carreras ..... A63B 21/4043
2022/0203202 A1 * 6/2022 Short ..... A63B 21/0557

* cited by examiner

RETRACTABLE HANDHELD EXERCISE APPARATUS

CROSS-REFERENCE TO RELATED APPLICATIONS

This application claims the benefit of U.S. Provisional Patent Application No. 63/169,981 filed Apr. 2, 2021, titled Retractable Handheld Exercise Apparatus the entire contents of which are incorporated by reference herein, for all purposes.

TECHNICAL FIELD

The present invention relates to providing adjustably-resistant, yet fluid, back-and-forth motion to the arms and upper body of a stationary user by pulling the individually attached handles to and from their attachment point in a cross-country ski poling motion. The invention bears a handle containing a spooled cable that extends and attaches to a fixed object. The handheld, spooled end of the cable is tracked through the handle itself through built-in pulleys into a retractor spring-based cable spool. The retractor spring itself can be wound to vary its resistance using a push-to-turn knob.

RELATED ART

Many exercise devices have attempted to provide back-and-forth arm motion resistance to stationary exercisers. With regard to purpose-built aerobic machines such as standup elliptical trainers, dedicated handlebars are linked directly to the resistance mechanism to provide back-and-forth arm resistance. Others have patented bulky add-ons to existing treadmills, while some went so far as to incorporate an upper body ski poling simulation into a cross-country ski simulation mechanism.

With regard to stationary users who do not possess an underlying exercise machine, various systems of pulley-guided or elastic, handheld cords have been developed to simulate upper body ski poling. These systems are typically semi-permanently affixed to a doorframe, doorknob, or other solid point.

Adding adjustable upper body resistance to exercise devices that do not already incorporate upper body motion naturally has required expensive, bulky add-ons that are not portable. By contrast, those which are more portable (e.g., elastic bands) are not typically adjustable. The Retractable Handheld Exercise Apparatus is designed to be both portable and adjustable, as well as inexpensive.

SUMMARY OF EMBODIMENTS

The present invention comprises a novel means to simulate cross-country ski poling via a handheld, self-contained, and retractable cable apparatus. Easily removable, transportable, and adjustable, the extending cable is looped onto a stable attachment point such as a treadmill frame using multiple means in order to provide a solid fixture.

Pulling the handheld unit away from the fixed attachment causes the cable to unspool from the internal, retractable cable spool system with light resistance, while moving the handle toward the fixed attachment will cause the cable to retract back inside the handle, similar to a retractable dog leash.

The amount of force required to pull the handheld unit away from the fixed attachment varies based on tightening (clockwise) or loosening (counter-clockwise) the knob atop the axle around which the retractor spring is coiled.

DETAILED DESCRIPTION OF THE DRAWINGS

Figure 1:
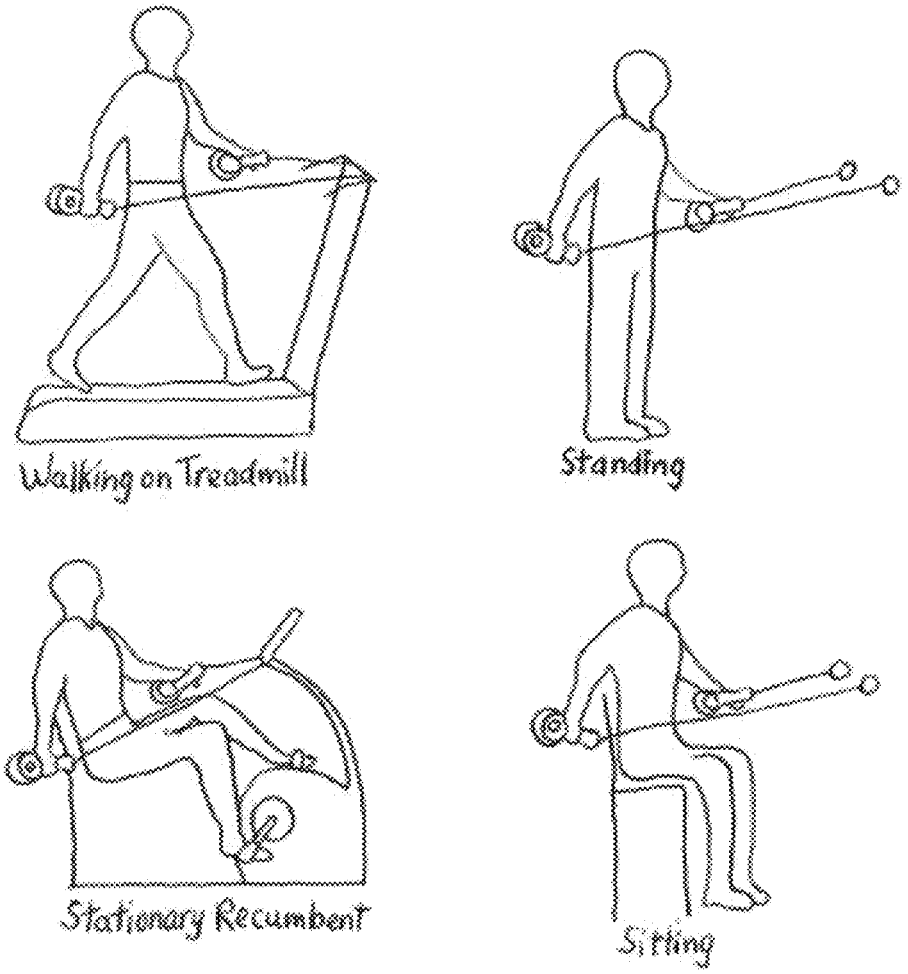
FIG. 1 is a set of illustrations showing examples of how the exercise device may be used.

Referring now to FIG. 1, we see users of the device holding a handheld unit in each hand while in a stationary position such as walking on a treadmill, pedaling a recumbent bike, or in a non-ambulatory standing or sitting position. Users move their arms back and forth mimicking an active walking manner as the cable is coiled and uncoiled within the handheld unit itself.

Figure 2:
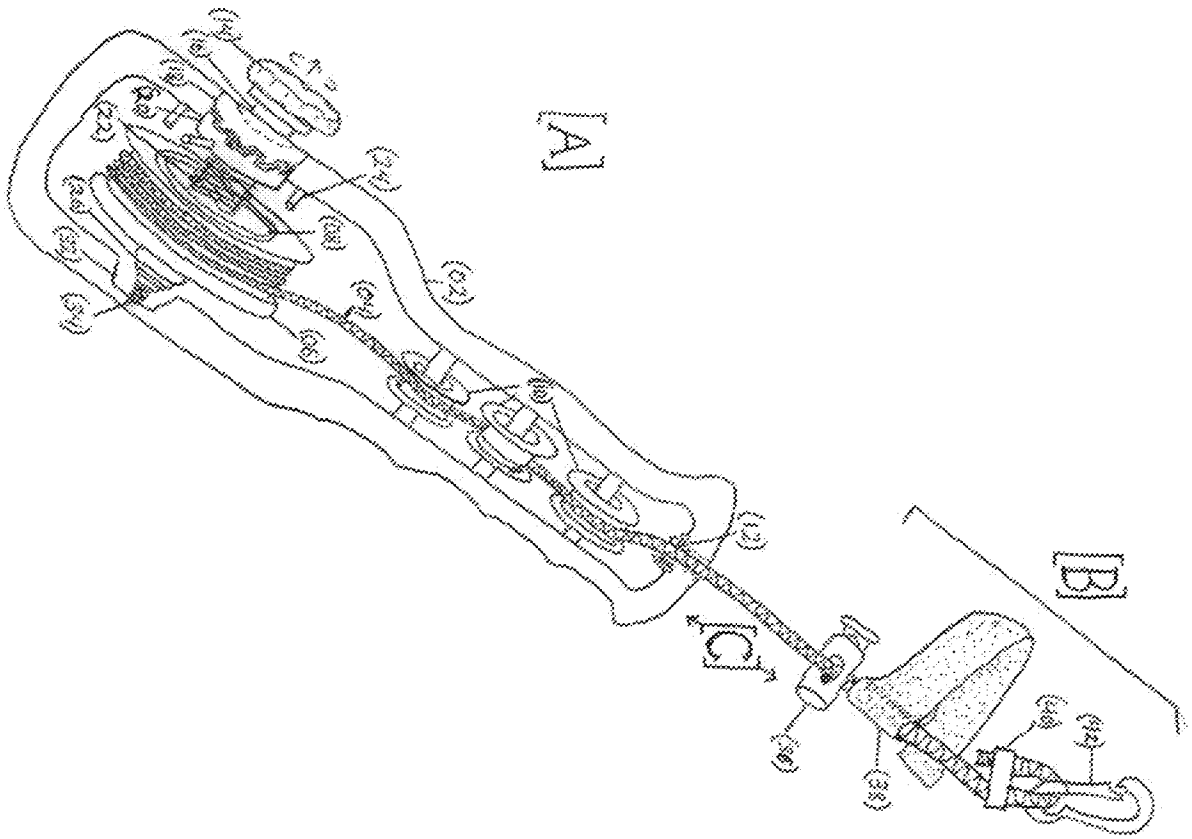
FIG. 2 is a top view of the entire apparatus including the inner workings of the handheld unit [A].

FIG. 2 is an end-to-end illustration of the device including the handheld unit [A], the attachment means [B], and the connecting cable [C] along which the handheld unit tracks to and from the attachment point. The handheld unit body (02) houses the cable (04) that coils around the cable spool (06) which holds the retractor spring housing (08) at its core. The cable is guided through the handle portion using three fixed pulleys (10) and exits through two fixed, smaller guide pulleys (12). The variable resistance knob (14) sits in the up, or "free-spin" position, showing the knob post (16) as it stands within the body (02) and extends down through the female lock teeth (18) which are fixed upon the body (02). Attached to the knob post (16) is a set of male lock teeth (20) which are separated from the retractor spring housing (08) by a main spring (22) wrapped around the knob post (16). Min/max stoppers (24) govern the variable resistance knob's (14) adjustment. The knob plunge (26) rests within the body's (02) hollow knob post housing (32) and is held up by a small plunge spring (34). Extending out to the attachment means [B] there is a sliding cord lock (36), sliding hook-and-loop fastener strap (38), cable clip (40), and carabiner clip hook (42), all of which contribute to establishing a solid cable [C] fixture.

Figure 3:
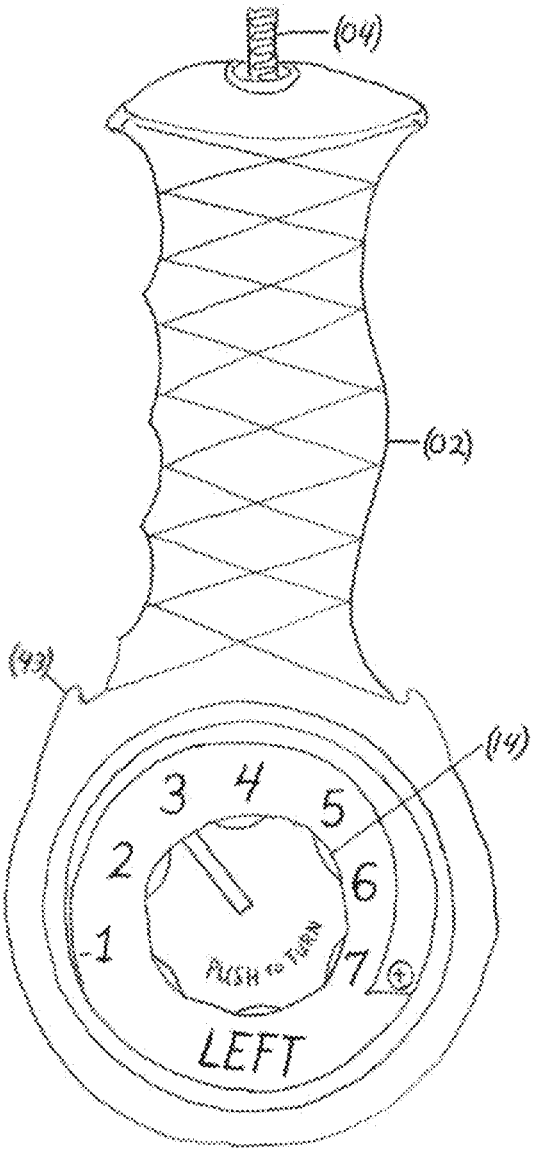
FIG. 3 is a side view of the outward part of the left handheld unit [A] showing the knob.

FIG. 3 is a top view of the left handheld unit [A] lying flat, showing the user's view of the variable resistance knob (14) in relation to the ergonomic body (02) and the cable (04) exit point. Weight band hooks (43) protrude in order to attach optional weight band straps.

Figure 4:
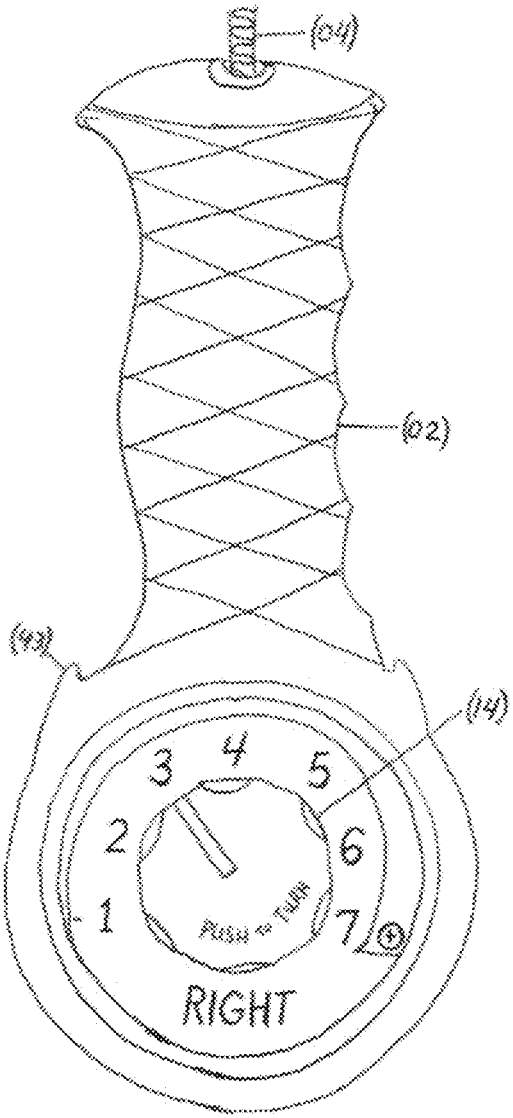
FIG. 4 is a side view of the outward part of the right handheld unit [A] showing the knob.

FIG. 4 is a top view of the right handheld unit [A] lying flat, showing the user's view of the variable resistance knob (14) in relation to the ergonomic body (02) and the cable (04) exit point. Weight band hooks (43) protrude in order to attach optional weight band straps.

Figure 5:
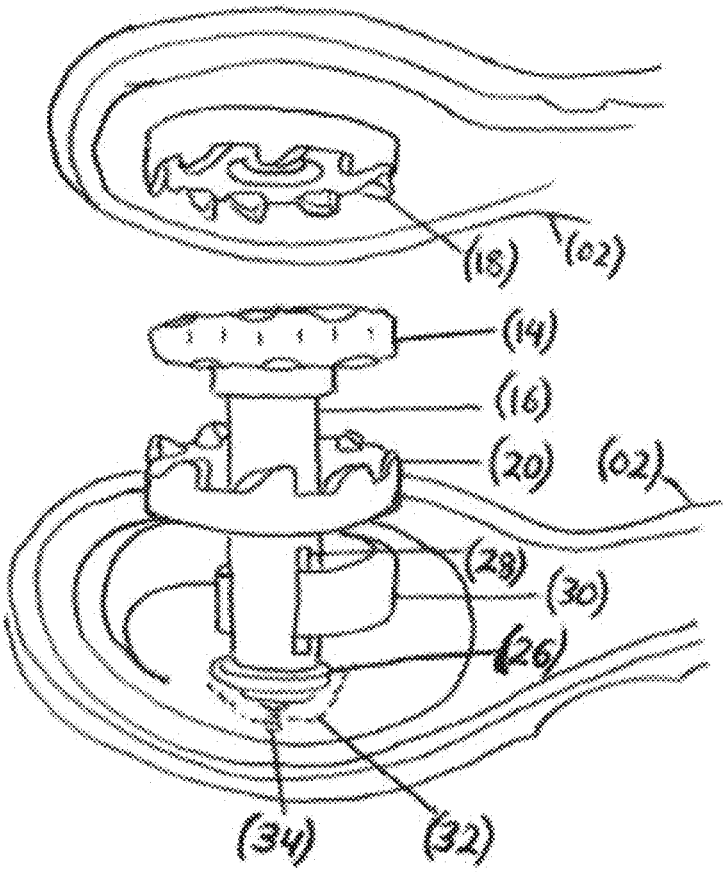
FIG. 5 is a top view of how the knob fits within the body to coil the retractor spring.

FIG. 5 shows the knob post (16) assembly in relation to both the body (02) and the retractor spring (30). As assembled, the upper body section (02) containing the female lock teeth (18) would rest just below the variable resistance knob (14) in order to align with the male lock teeth (20) on the post. The retractor spring (30) coils around the knob post (16) and is fixed to the post through a slit (28) which allows for the adjustment necessary to separate teeth locks (18) and (20) without displacing the retractor spring (30). The knob plunge (26) rests within the body's hollow knob post housing (32) and is held up by the small plunge spring (34).

Figure 6:
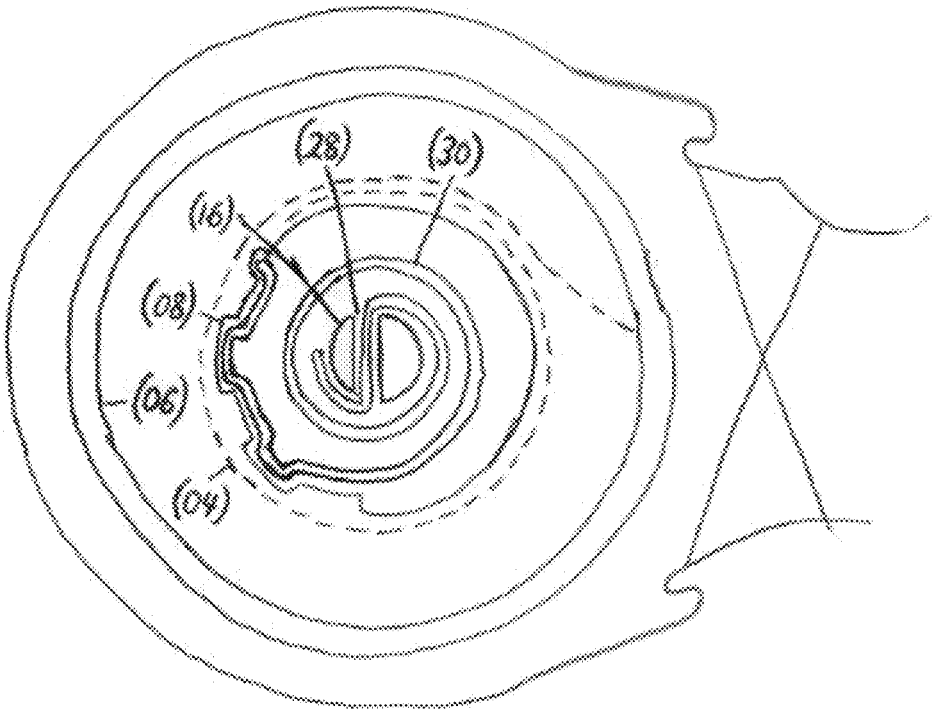
FIG. 6 is a side x-ray view of the inward part of handheld unit [A] showing the retractor spring housing.

FIG. 6 is an exposed view of the retractor spring housing (08) looking up from the smooth, inward side of the handheld unit [A]. The cable (04) goes around the cable spool (06) and is affected by the retractor spring housing (08) which contains both the knob post (16) containing the slit (28) for the retractor spring (30) and the retractor spring itself. Turning the knob post (16) in a clockwise direction (counter-clockwise from the user's opposite perspective) relaxes the retractor spring (30) within the retractor spring housing (08), while a counter-clockwise turn (clockwise from the user's opposite perspective) winds the retractor spring (30) more tightly around the knob post (16).

Figure 7:
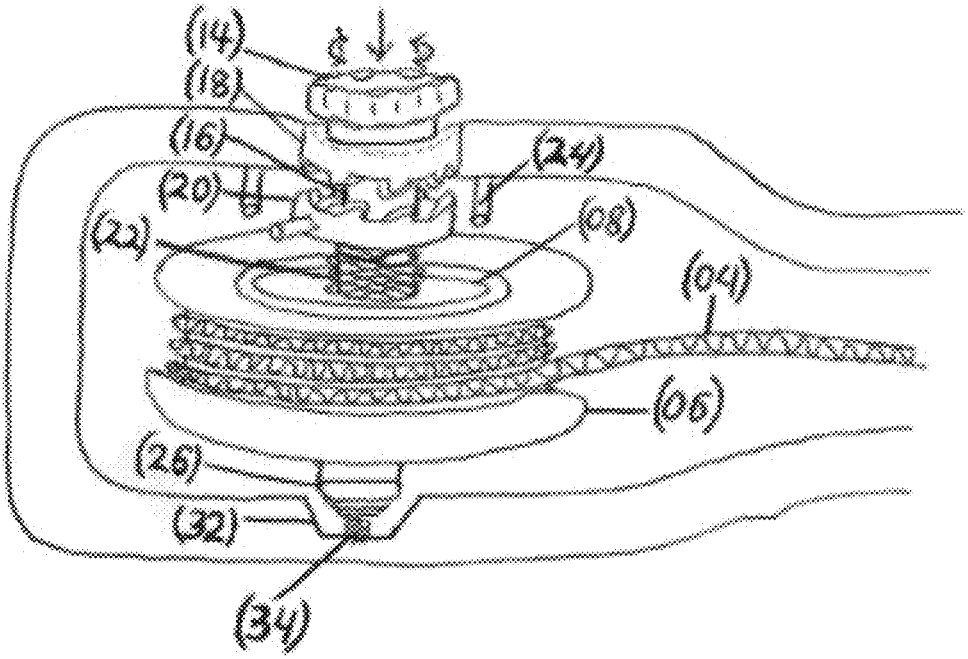
FIG. 7 is a top view of the lock teeth separated by the push-to-turn variable resistance knob.

FIG. 7 is an exposed top view of the handheld unit [A] showing how the "Push to Turn" variable resistance knob (14) is used to modify tension by disengaging the male lock teeth (20) from the female lock teeth (18). As the knob (14) is pushed down, the underside of the male lock teeth (18) presses down on the spring (22) and is opposed by the fixed retractor spring housing (08). At the same time, the knob plunge (26) presses down on the small plunge spring (34) to provide smooth resistance and overall knob post (16) stability. Once the male lock teeth (20) are separated from the female lock teeth (18), the variable resistance knob (14) can be turned in either direction, governed only by the min/max stoppers (24). Once the user dials the variable resistance knob (14) to the desired tension level and stops pushing down, both the main spring (22) and the small plunge spring (34) serve to push the knob post (16) up to the open, free-spin position while the male lock teeth (20) settle into their nearest symmetrical, locked position relative to the female lock teeth (18).

Figure 8:
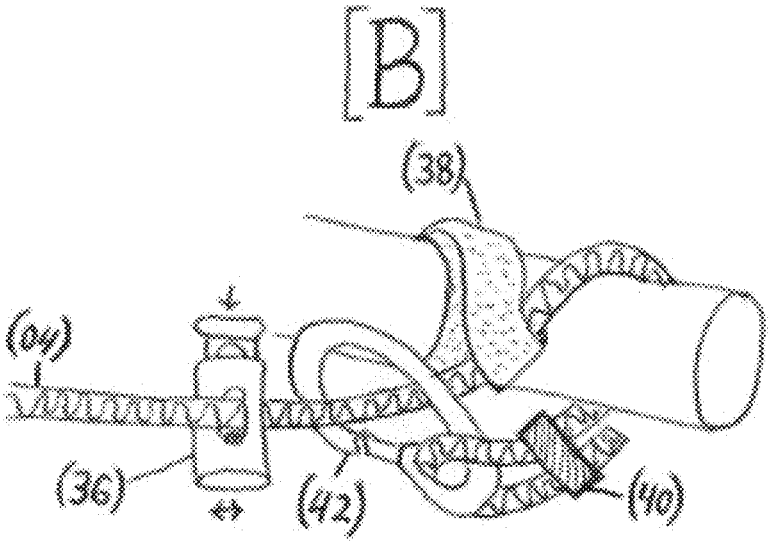
FIG. 8 is a side view of how the attachment means [B] is secured to a fixed object.

FIG. 8 shows the attachment means [B] in use. To establish an attachment that will be fixed from all directions, the cable (04), which may vary in length where some instances are 2 ft and other instances are 10 ft or more, is fixed to a carabiner clip hook (42) using a cable clip (40). During use, the cable (04) is looped around a fixed object and clipped back onto the cable (04) itself using the carabiner clip hook (42). The sliding cord lock (36) is then pressed open to slide and lock flush with the most tightly-looped part of the carabiner clip hook (42). The final secure attachment step is to wrap the sliding hook-and-loop fastener strap (38) around the fixed attachment point itself and/or the connection point of the cord lock (36) and carabiner clip hook (42).

Figure 9:
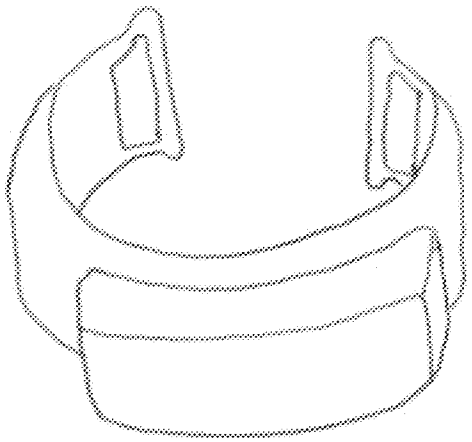
FIG. 9 is a side view of an optional weight band strap that houses a variable weight mass as it would appear wrapped around the outer retractor spring housing.

FIG. 9 shows an optional weight band. Available in varying weights, the user can attach the weight band using the associated weight band hooks (43). Variable handle weights allow users to adjust ski poling difficulty from one workout to the next.

Figure 10:
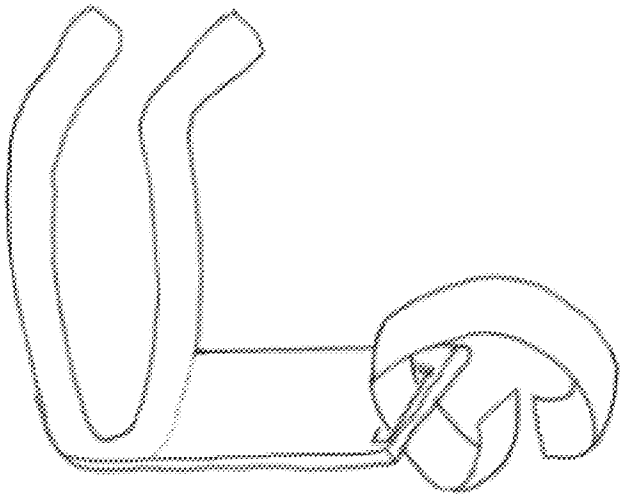
FIG. 10 is a side view of a device storage unit.

FIG. 10 shows a device storage unit which is large enough to accommodate the handle, yet smaller than the flared tip so that it hangs from the flared tip end with the cord exit pointing upward when not in use.

Different embodiments may include:

1) Models with greater relative tension.
2) Handles with greater absolute weight.
3) Handles with varying sizes.
4) Cords of varying length.
5) Removable weights attached to the round, cable spool portion of the handle so that the user can vary the amount of handle weight by routine. One example could be 11*b* while another could be 51*b* or more.
6) Removable storage clip mounts to house the units on a fixed device (e.g., treadmill) when not in use.

What is claimed as new is as follows:

With so few ways to provide upper-body aerobic resistance to treadmills and other stationary positions, this adjustable, handheld upper body exercise device simulates ski-poling style upper body exercises from any fixed point. This device can also be used while seated in a chair or standing still. This device also adds upper body ski poling resistance to fixed exercise machines like treadmills and recumbent stationary bikes. When used as such with a machine, this device allows the user to maintain a slightly more rapid pace if desired. This is accomplished by increasing the adjustable tension which forces the user to pull back with greater force, thereby simulating an uphill motion.

Therefore, I claim:

1. A retractable, handheld upper body exercise device comprising:

a pair of handheld units, each handheld unit comprising:

a retracting cable spooled from within the corresponding handheld unit;

an attachment portion connected to a distal end of the retracting cable and configured to be coupled with an attachment point distinct from and external to the retractable, handheld upper body exercise device; and a series of pulleys built into each handheld unit to guide the retracting cable consistently to and from a handle exit point of the corresponding handheld unit and to further aid in fluidity of a progression of the retracting cable through the corresponding handheld unit;

wherein the pair of handheld units are configured to be moved by a user to and from the attachment point to add light, ski-poling resistance to an upper body walking motion of the user.

2. The retractable, handheld upper body exercise device in claim 1 further comprising a retractor spring having a tension that can be adjusted via a push-to-turn, self-locking post that houses a core of the retractor spring.

3. The retractable, handheld upper body exercise device in claim 1, wherein the attachment portion allows the retractable, handheld upper body exercise device to be safely secured to a wide variety of fixed points that include the attachment point.

4. The retractable, handheld upper body exercise device in claim 1, wherein the pair of handheld units are left-hand and right-hand units each comprising handles that differ between the left-hand and right-hand units, respectively, yet are identically symmetrical to respectively fit left-hand and right-hand palms of the user.

5. The retractable, handheld upper body exercise device in claim 1, wherein each handheld unit is flared on both ends to prevent slippage and is ergonomically designed to be easily gripped by most everyone.

6. The retractable, handheld upper body exercise device in claim 1, wherein each handheld unit is dome-shaped at a tip thereof near an external cable exit point of the corresponding handheld unit to allow arms of the user to swing more freely and with a least possible amount of friction on the retracting cable as the retracting cable moves through the external cable exit point.

* * * * *